US005394937A

United States Patent [19]

Nieh

[11] Patent Number: 5,394,937

[45] Date of Patent: Mar. 7, 1995

[54] VORTEX HEAT EXCHANGE METHOD AND DEVICE

[76] Inventor: Sen Nieh, 14345 Hollyhock Way, Burtonsville, Md. 20866

[21] Appl. No.: 192,742

[22] Filed: Feb. 7, 1994

Related U.S. Application Data

[62] Division of Ser. No. 26,048, Mar. 5, 1993.

[51] Int. Cl.[6] ..... F28D 7/12

[52] U.S. Cl. ..... 165/156; 165/108; 165/164

[58] Field of Search ..... 165/108, 155, 156 I, 165/164; 137/875

[56] References Cited

U.S. PATENT DOCUMENTS

| | | | |
|---|---|---|---|
| 2,707,444 | 5/1955 | Van Loon . | |
| 3,335,790 | 8/1967 | Aranyi | 165/156 X |
| 3,830,293 | 8/1974 | Bell | 165/108 X |
| 4,161,917 | 7/1979 | Jubb . | |
| 4,232,633 | 11/1980 | Chambert . | |
| 4,349,354 | 9/1982 | Flesch . | |
| 4,388,766 | 6/1983 | Sanderson | 137/875 |
| 4,406,214 | 9/1983 | Sakurai | 137/875 X |
| 4,457,289 | 7/1984 | Korenberg . | |
| 4,469,050 | 9/1984 | Korenberg . | |
| 4,473,033 | 9/1984 | Strohmeyer, Jr. . | |
| 4,475,472 | 10/1984 | Adrian et al. . | |
| 4,532,871 | 11/1985 | Van Gasselt et al. . | |
| 4,548,138 | 10/1985 | Korenberg . | |
| 4,683,541 | 7/1987 | David . | |
| 4,683,840 | 8/1987 | Morin . | |
| 4,688,521 | 8/1987 | Korenberg . | |
| 4,708,068 | 11/1987 | Hattori et al. . | |
| 4,744,312 | 5/1988 | Narisoko et al. . | |
| 4,766,851 | 8/1988 | Emsperger et al. . | |
| 4,768,948 | 9/1988 | Hansen et al. . | |
| 4,788,919 | 12/1988 | Hoim et al. . | |
| 4,807,665 | 2/1989 | Schiel | 137/875 X |
| 4,864,944 | 9/1989 | Engstrom et al. . | |
| 4,867,079 | 9/1989 | Shan et al. . | |
| 4,917,028 | 4/1990 | Ganster et al. . | |
| 4,934,931 | 6/1990 | Angelo, II . | |
| 4,970,804 | 11/1990 | Huttlin . | |
| 4,993,332 | 2/1991 | Boross et al. . | |
| 5,003,931 | 4/1991 | Huschauer . | |
| 5,014,631 | 5/1991 | Ikeda et al. . | |
| 5,123,361 | 6/1992 | Nieh et al. . | |
| 5,174,799 | 12/1992 | Garcia-Mallol . | |

*Primary Examiner*—Stephen M. Hepperle
*Attorney, Agent, or Firm*—Cushman, Darby & Cushman

[57] ABSTRACT

A vortex heat exchanger device for the heat transfer between fluids of different temperatures that flow through the device. The vortex heat exchanger comprises a plurality of tubes each of a different diametric and each disposed concentrically relative to one another to define a plurality of channels. Fluid is tangentially introduced into the channels through at least two inlets, and fluid is tangentially emitted from the channels through at least two outlets. The tangential arrangement of the inlets and the outlets allow the fluids to flow through the annular channels in a vortex pattern.

12 Claims, 4 Drawing Sheets

124
104
114
102
134
142
106
140
100
126
108
128
120
134
130
116
112
110
132
136
138
138
122
118

VORTEX HEAT EXCHANGE METHOD AND DEVICE

This is a division of application No. 08/026,048, filed Mar. 5, 1993, pending.

BACKGROUND OF THE INVENTION

1. Field of the Invention

The present invention relates generally to a method of heat transfer and a heat exchange device therefor, and more particularly to a vortex heat transfer method and a vortex heat exchange device therefor.

2. Description of the Art

Heat exchangers are devices that transfer heat between fluids of different temperatures. Heat exchangers are widely used in industries of all types, e.g., power generation, chemical processing, food, metallurgy, energy, aerospace and aeronautics, air-conditioning and refrigeration, automotive, and other types of manufacturing. Since such a wide range of industries use heat exchangers, various types of heat exchangers are available.

Traditionally, heat exchangers are designed and modified based on Newton's Law of Cooling:

$$Q=hA\Delta T \quad (1)$$

where Q is the rate of heat transferred between two fluids, $\Delta T$ is the average temperature difference between the hot and cold fluids, A is total surface area for heat transfer, and h is a constant called heat transfer coefficient. In reality, h is not a constant but is rather a complex parameter. The heat transfer coefficient h changes with the geometry and arrangement of the system, and the fluids and their characteristics within the system. While equation 1 is an over-simplification of the fundamental phenomena of heat convection, it does demonstrate that the rate of heat transferred is proportional to the heat transfer surface area, the average temperature difference between the two fluids, and the heat transfer coefficient.

The object of heat exchangers is to increase the rate of heat transferred between fluids. Equation 1 suggests that by increasing A, $\Delta T$, or h, in any combination, Q will increase. In actual applications, however, it is usually difficult to increase A greatly because of the size and costs of the heat exchanger is predefined by its application. It is also difficult to increase $\Delta T$ because the average temperature differential must conform to the application conditions. Because of these restraints, most heat exchangers primarily rely on improvements in the heat transfer coefficient. Accordingly, heat exchangers have evolved from the double-pipe, to the tube-and-shell, the finned plate (cross-flow), the tube inserts, and to the recent impulse flow heat exchanger.

Since most design and operating variables of heat exchangers are lumped into the complex heat transfer coefficient, designers have less chance to pursue a comprehensive optimization of the performance of heat exchangers using the adjustable variables. Many of the measures taken so far tend to be straight forward but have had limited effect. For example, a large increase in the flow velocities of the hot and cold fluids can greatly increase h. However, the increase in flow velocity also increases the required pressure drops (or required pumping power to achieve the desired velocity) in the system. The increase in flow velocity shortens the residence time of hot and cold fluids which reduces the effect of improvement in Q.

SUMMARY OF THE INVENTION

As is evident from the foregoing description, there are a number of limitations to existing methods of heat transfer and heat exchangers therefore. Therefore, it is an object of the present invention to provide an improved method of heat transfer that increases the residence time and flow path within the device and the total effective heat transfer surface area.

It is a further object of the present invention to provide an improved heat exchange device that increases the residence time and flow path within the device and the total effective heat transfer surface area.

It is yet a further object of the present invention to provide a method of heat transfer and a device therefor that recycles the fluids through the device.

It is still a further object of the present invention to provide a method of heat transfer and a device therefor that varies the flow and amount of fluid proceeding through the device.

To achieve these purposes, the present invention provides a method of heat transfer between fluids of different temperatures. The method tangentially introduces a fluid into a heat exchanger device so that the fluid proceeds through the device in a selected direction along a vortex pattern, that is, along a generally spiral path. Simultaneously, the method tangentially introduces another fluid into a separate channel so that it proceeds through the device in an opposite direction relative to the selected direction along a vortex pattern. While the fluids proceed through the device heat is exchanged between the fluids according to the path and time of the fluid through the device. To change the path and the time of the fluids within the device, the method can also provide for recycling the fluids through the device or varying the flow and amount of fluid through the device. By recycling and varying the flow and amount of fluids through the device, the method can adjust to changing circumstances and increase the heat exchanged between the fluids.

The vortex heat exchange device using the method of heat transfer described above comprises a plurality of tubes each of a different diameter and each disposed concentrically relative to one another to define a plurality channels.

Fluids of different temperatures are tangentially introduced into the channels of the device through inlets. Each inlet is tangential to the channel so that the fluid flows through the annular channel in the desired vortex pattern. Furthermore, the direction of the vortex for the fluids are either counter or parallel to one another. The fluids proceed through the device in their pattern and are emitted from the channels through multiple outlets. The temperatures of the fluids change according to the path and the time of the fluids through the device. To change the path and time of the fluids through the device, the device can recycle the fluids within the device or vary the flow and amount of fluids that flow into and out of the device.

It is another object of the present invention to use the method of heat transfer and the heat exchanger device of the present invention in an air cooler/heater.

It is still another object of the present invention to provide a heat exchanger for a portable and convenient air cooler/heater.

It is yet another object of the present invention to provide a heat exchanger that has a high intensity, high efficiency, and flexible operation.

It is still yet another object of the present invention to provide a heat exchanger to be used in an air cooler/-heater that has no compressor.

It is an additional object of the present invention to provide a heat exchanger to be used in an air cooler/-heater that does not need a refrigerant, e.g, CFC.

It is yet an additional object of the present invention to provide heat exchanger to be used in an air cooler/-heater that has small thermal inertia, and quick cooling-/heating.

To achieve these purposes, the present invention provides an air cooler/heater comprising at least two concentric tubes that define an outer channel and inner channel. The outer channel may be partitioned into two outer channels. The first outer channel has an inlet and a tangential outlet to introduce and emit air, respectively. The second outer channel has a tangential inlet and a tangential outlet to introduce and emit air, respectively. Air flows through both outer channels in a vortex pattern. The inner channel has one inlet and outlet, and the air flows through the channel in a vortex pattern.

The tube between the outer and the inner channel comprises multiple panels of insulation and thermoelectric sheets. The thermoelectric sheets are heavily doped to create an excess or deficiency of electrons to achieve the Peltier effect when current is supplied to the sheets. Accordingly, heat is absorbed from the air at the cold junction and heat is emitted into the air at the hot junction. Therefore, as the air proceeds through the air cooler/heater, the air in the inner channel is cooled by the thermoelectric sheets and by the heat exchange caused by the vortex pattern, and the air in the outer channel is heated by the thermoelectric sheets and by the heat exchange caused by the vortex pattern.

The present invention lends itself to incorporation into a radator, preheater or similar device that can be used in an automobile or other industrial applications.

Other objects and advantages of the present invention will become apparent from the following detailed description of a preferred embodiment of the invention taken in conjunction with the accompanying drawings.

DETAILED DESCRIPTION OF THE PRESENTLY PREFERRED EXEMPLARY EMBODIMENTS

Figure 1:
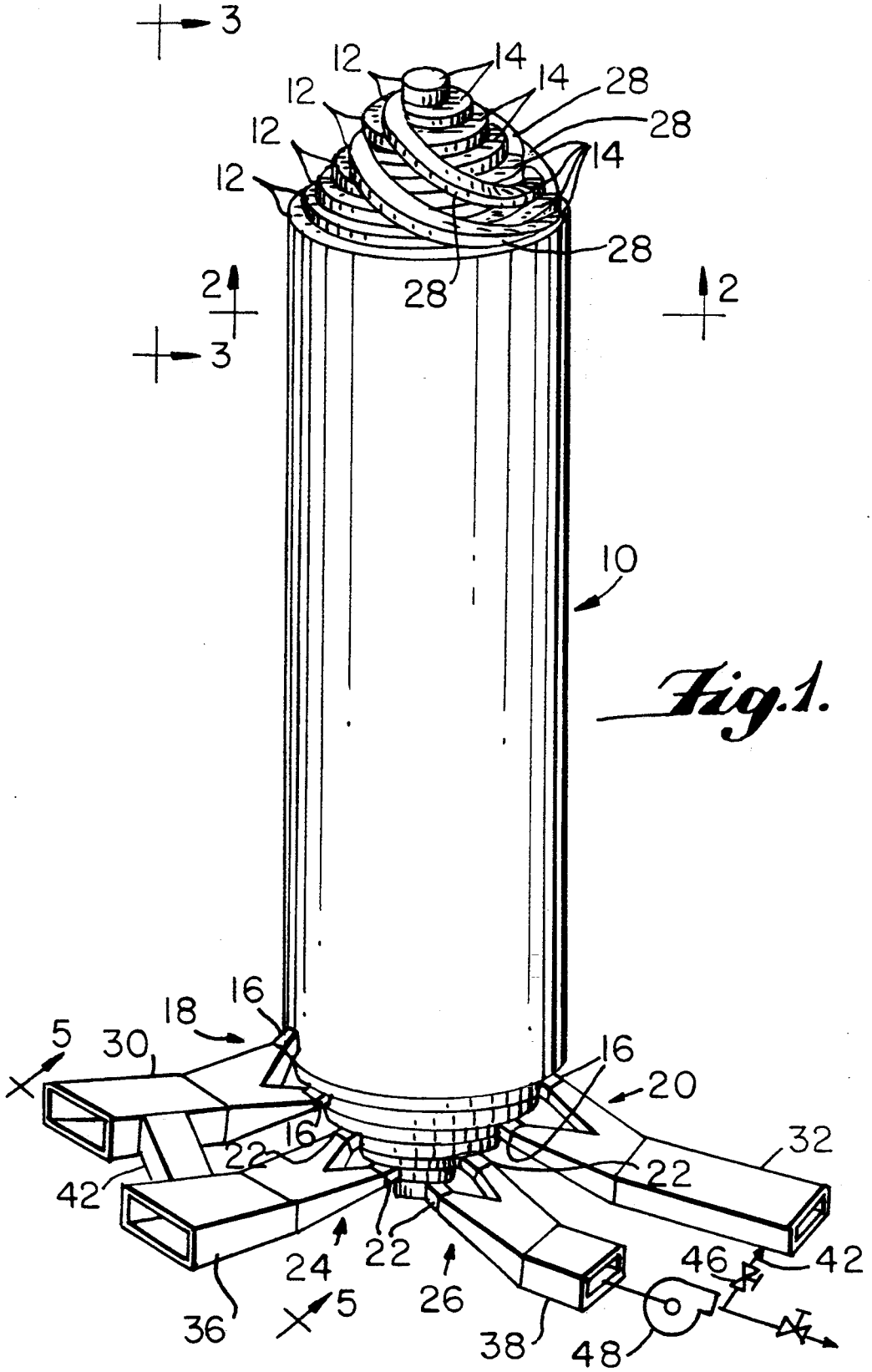
FIG. 1 is an isometric view of a multichannel recirculatory vortex heat exchanger embodying the principles of the present invention.

The present invention is based on supplements to Newton's Law of Cooling, which will provide a detailed analysis of the design of the heat exchanger. The supplemented equation is:

$$Q = mC_p(T_{out} - T_{in}) \tag{2}$$

or more precisely $$Q = mC_p \int_0^s \frac{dT}{ds}\, ds \cong mC_p \sum_i \left(\frac{dT}{ds}\right)_i \Delta s_i \tag{3}$$

or $$Q = mC_p \int_0^\Gamma \frac{dT}{dt}\, dt \cong mC_p \sum_i \left(\frac{dT}{dt}\right)_i \Delta t_i \tag{4}$$

where m is the mass flow rate of the fluid, $C_p$ is the fluids specific heat at constant pressure; $mC_p$ is the thermal capacity of the fluid; $T_{out}$ and $T_{in}$ are the outlet and inlet fluid temperatures, respectively; s is the flight distance along the flow path; S is the total distance; t is the time; $\Gamma$ is the total residence time of the fluid in the device; ds, dt, $\Delta s$, $\Delta t$ are differential or minor changes of s and t; dT/ds is the rate of change of temperature along the flow path, and dT/dt is the rate of change of temperature over time.

As formulas 3 and 4 above indicate, Q can be increased by increasing any combination of the values $mC_p$, dT/ds, dT/dt, S or $\Gamma$. Accordingly, there are benefits of using fluids with large thermal capacities, long flight patterns and long residence times. These objects can be accomplished by using a vortex heat exchanger or a recirculatory vortex heat exchanger. A large temperature gradient dT/ds or dT/dt along the flow directions is realized by improving the heat transfer between the fluids and the walls of the heat exchanger. For maximum improvement in heat exchange, increases should occur in all of the above parameters while not reducing another parameter.

To achieve the largest total distance through the device and to increase the residence time, the present invention employs a vortex pattern for the fluids to proceed through. To increase the thermal capacity within the device the present invention envisions recycling fluids through the vortex. Recycling fluids allows the device to be of any size depending on the application of the heat exchanger as well as accommodate a larger range of input temperature differences. Furthermore, to change the distance the fluids flow through the device and residence time, the present invention provides a way to regulate the flow rate and the amount proceeding through the vortex of the device at any time. This feature allows the heat exchanger to adjust to the whole system under different conditions, such as start up and shut down.

The heat transfer coefficient is proportional to the velocity v of the fluids in the vortex through the heat exchange device, where:

$$h \propto V^{0.8} \tag{5}$$

The velocity is determined by:

$$V = \sqrt{u^2 + w^2} = u\sqrt{1 + \frac{w^2}{u^2}} = u\sqrt{1 + \beta^2} \tag{6}$$

where w is the tangential velocity through the channel and u is the axial velocity through the channel.

The vortex effect of the vortex heat exchange device is derived from the above equations to be:

$$\frac{h_{VHE}}{h_o} \cong \left(\frac{V}{u}\right)^{0.8} = (\sqrt{1+\beta^2})^{0.8} \quad (7)$$

where $h_{VHE}$ is the heat transfer coefficient for the vortex heat exchanger and, $h_o$ is the heat transfer coefficient of heat exchange without vortex.

The recirculatory effect of the heat transfer between fluids is given by:

$$\alpha = \frac{m_R}{m} \quad (8)$$

where mr is the mass flow rate of recycled fluid, m is the mass flow rate of fluid coming to (or leaving from) the vortex heat exchanger and the total mass flow rate through the recirculatory vortex heat exchanger will be m $(1+\alpha)$, which is an $\alpha$-fold increase. Accordingly, the advantage of the recirculatory vortex heat exchanger can be demonstrated:

$$\frac{h_{RVHE}}{h_o} \cong (\alpha\sqrt{1+\beta^2})^{0.8} \quad (9)$$

where $h_{RVHE}$ is the heat transfer coefficient for the recirculatory heat exchanger.

Referring now to the drawings, and more particularly to FIG. 1, there is shown therein a vortex heat exchange device, generally indicated at 10, which embodies the principles of the present invention. The vortex heat exchange device 10 comprises four basic components: (1) multiple concentric tubes 12; (2) multiple channels 14 defined by the tubes 12; (3) multiple inlets 16 into the channels; and (4) multiple outlets 22 from the channels.

The tubes 12 can be of any material that allows the transfer of heat between the channels 14. The tubes are of different diameters and disposed concentrically relative to one another. In this way, the channels 16 are defined between the tubes 12. The channels 14 are annularly unobstructed from one end to the other because the walls of the tubes are smooth. Accordingly, there are no hindrances for the fluids within device 10 as the fluids proceed from the inlets 16 to the outlets 18. FIG. 1 shows eight tubes forming eight channels 14. The number of tubes can change, however, thereby changing the number of channels.

The channels 16 are divided into two sets. The first set, generally indicated at 18, is for a fluid of one initial temperature, and the second set, generally indicated at 20, is for a fluid of another initial temperature. The inlets 16 for each set are on opposite sides of the device 10. The inlets 16 are also arranged so that the fluids alternate between the channels 14. Thus, a fluid at one temperature runs in a channel next to a fluid at another temperature.

Figure 2:
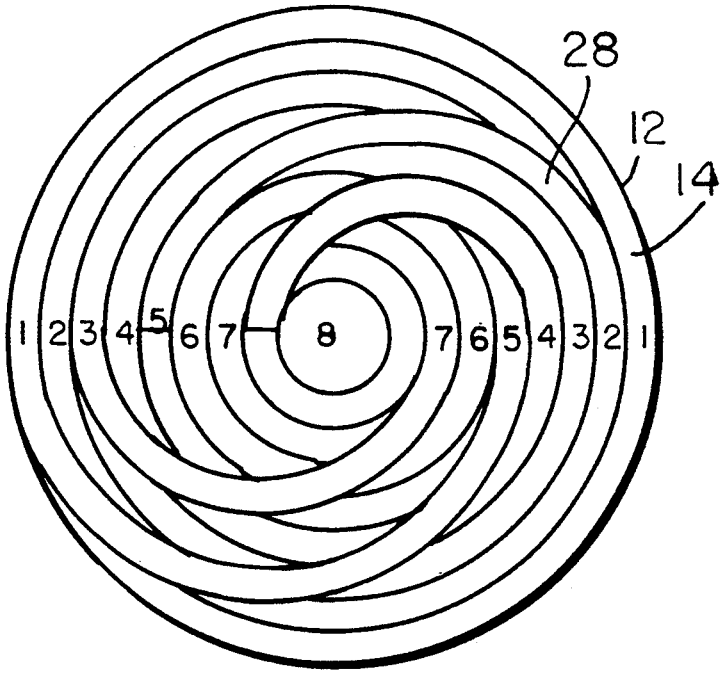
FIG. 2 is a sectional view of the multichannel recirculatory vortex heat exchanger taken along the line 2—2 in FIG. 1.

Each inlet 16 is tangential to the channel 14 it introduces a fluid to as shown in FIG. 2. This tangential arrangement between the inlets 16 and the channels 14 forces the fluid to flow through the channel 14 in a vortex pattern as indicated by the arrows in FIG. 2. The inlets 16 are positioned at opposite ends of device 10 so that the vortex's direction of a fluid at one temperature is counter to the vortex's direction of the other fluid. The counter directions of the fluids is also shown in FIG. 2. The vortex pattern increases both the path the fluid uses as it proceeds through the channel 14 and the residence time of the fluid in the channel.

At the same end of the device 10 as inlets 16, outlets 22 are positioned and are attached to the second set of channels 14. The outlets 22 allow the fluids that flow through the channels in a vortex pattern. Similarly to the inlets 16, there are two sets of outlets, generally indicated at 24 and 26. The first set 24 is for fluid of one temperature, and the second set 26 is for fluid of another temperature.

Figure 3:
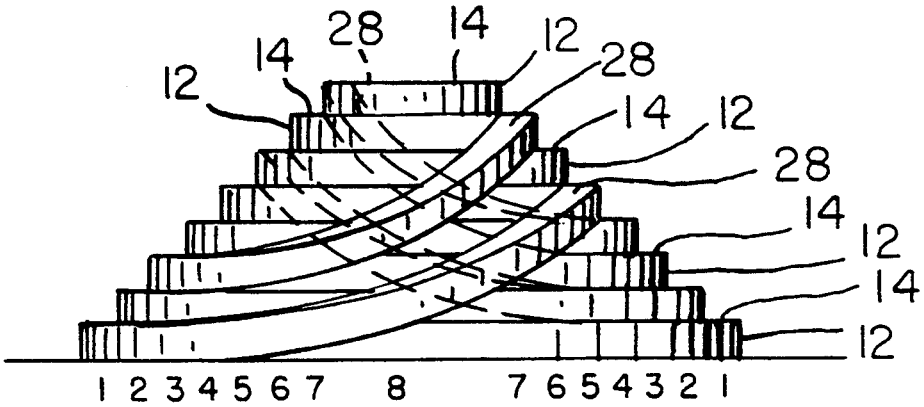
FIG. 3 is a fragmentary frontal view of the multichannel recirculatory vortex heat exchanger taken along the line 3—3 in FIG. 1.

At the opposite end of channels 14 from inlets 16 and outlets 22 are channel connectors 28, as seen in FIGS. 1 and 3. The connectors 28 connect the first set of channels to the second set of channels. Accordingly, a channel with an inlet is connected to a channel with an outlet so that a fluid can flow through the device 10. The connectors 28 are tangential to both sets of the channels. Accordingly, the fluids proceed through the second set of channels in a vortex pattern similar to the pattern in the first set of channels but in the opposite sense. Furthermore, the connectors 28 are arranged so that the alternating pattern of fluids created by the arrangement of the inlets 16 is maintained in the channels with the outlets.

As the fluids proceed from the inlets 16 to the outlets 22, the different temperatures between the two fluids cause a heat transfer according to the formulas given above. The total distance of each fluid is governed by its vortex path, and the total residence time of the fluid is determined by the amount of time it takes the fluid to proceed through its vortex path. Because there are no obstructions in the channels 14, the path and time of the fluids in the vortex are not adversely affected. In other words, the concentric arrangement of the tubes and the smooth walls of the channels define a pure annular path between the tangential inlet and the complementary tangential outlet.

Figure 5:
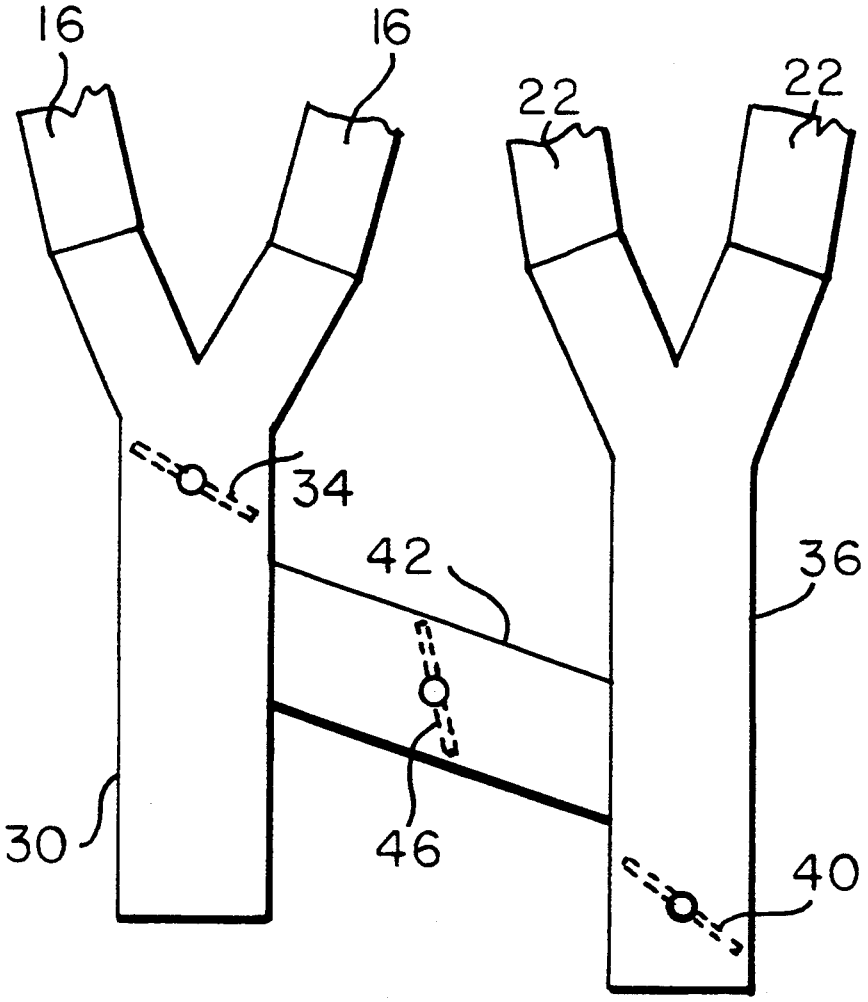
FIG. 5 is a sectional view of the inlets and outlets of the multichannel recirculatory heat exchanges taken along the line 5—5 in FIG. 1.

As seen in FIGS. 1 and 5, each set of inlets 18 and 20 are connected by common inlets 30 and 32, respectively. The common inlet 30 of first set is connected to a source for a fluid at one temperature. The common inlet 32 of the second set is connected to a source for a fluid at another temperature. Within each common inlet 30 and 32, there is a first vane 34. Vanes 34 are movable within the common inlet. Because they are movable, the rate and amount of fluid flowing from the common inlets 30 and 32 into the inlets 16 can be regulated.

Similarly to the inlets 16, each set of outlets 24 and 26 are joined by common outlets 36 and 38, respectively. Within each common outlet 36 and 38, there is a second vane 40.

Common inlets 30 and 32 and common outlets 36 and 38 are connected by recycle connectors 42 and 44, respectively. Recycle connectors 42 and 44 allow fluids to continue to flow through the device for longer periods of time thereby also creating longer distances within the device. Within each recycle connector 42 and 44 is a third vane 46. Third vanes 46 are movable thereby allowing the flow and amount of fluid recycled in device 10 to be regulated. A lower 40 may be necessary to cause fluid to be recycled between common inlets 30 and 32 and common outlets 36 and 38 through recycle connectors 42 and 44. A blower 48 may be necessary to cause fluid to be recycled between common inlets 30 and 32 and common outlets 36 and 38 through recycle connectors 42 and 44.

A specific application of the vortex heat exchangers described above is in an air cooler/heater. The air cooler/heater device is a vortex heat exchange device, described above, which uses thermoelectric sheets in one of the tubes. The thermoelectric sheets are used because they provide cooling within the device using the Peltier effect.

The Peltier effect is the transformation of heat into electrical energy or electrical energy into heat at the junction of dissimilar conducting materials. For the most efficient Peltier effect, semiconductor materials are used by doping the semiconductors with an excess or deficiency of electrons which create n-type and p-type materials. The amount of heat absorbed or emitted by the thermoelectric sheets is directly proportional to the current and the Peltier coefficient. The current to the thermoelectric materials is provided by a power source. The Peltier coefficient depends on the material used, which is most often bismuth telluride. The thermoelectric properties can be enhanced with various dopants of electrons. To further increase the pumping capacity of the thermoelectric sheets, multiple couples can be put into series or parallel.

Figure 4:
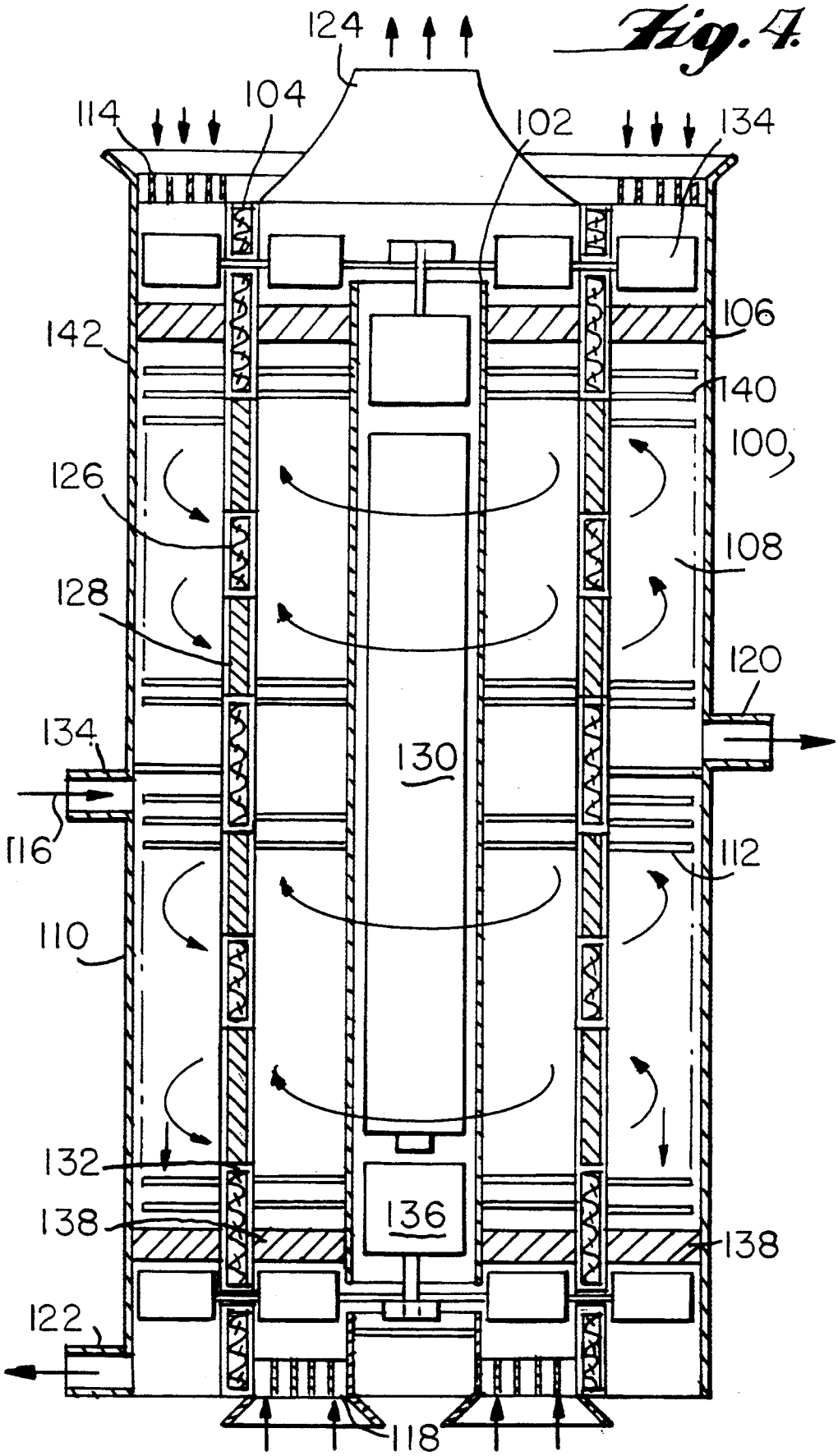
FIG. 4 is a sectional view of a air cooler/heater embodying the principles of the present invention.

FIG. 4 is a sectional view of an air cooler/heater device, generally indicated at 100, utilizing the vortex heat exchanger described above and the thermoelectric plates arranged for the Peltier effect. The air cooler/heater is comprised of several components: a) multiple concentric tubes 102, 104 and 106; b) multiple channels 108, 110 and 112 defined by the tubes 102, 104 and 106; c) multiple inlets 114, 116 and 118 into the channels 108, 110 and 112; d) multiple outlets 120, 122 and 124 out of the channels 108, 110 and 112; e) insulation 126; f) thermoelectric sheets 128, and g) a power supply 130.

There are generally three concentric tubes although more can be provided. Inner tube 102 surrounds the power supply 130. The middle tube 104 comprises alternating panels of the insulation 126 and the thermoelectric sheets 128. The thermoelectric sheets 128 are positioned so that the flow of electrons in the sheets 128 is from the channel which is cooling the air, to the channel which is warming the air. In other words, the cold junction absorbs the heat from the channel which is cooling the air and the hot junction pumps heat into the channel which is heating the air. In the embodiment shown in FIG. 4, the thermoelectric sheets 128 are arranged so that the inner channel 112 cools the air and the outer channels 108 and 110 warm the air. The thermoelectric sheets 128 are connected to the power supply 130 by leads 132 and is connected on the side of the sheets that is warming the air.

The two outer annular channels 108 and 110 are separated by partition 134, which connects the outer tube 106 to the middle tube 104. Ambient air is introduced into outer channel 108 by the inlet 114, and ambient air is introduced into outer channel 110 by the inlet 116. Air exits outer channel 108 through outlet 120, and air exits outer channel 110 through the outlet 122. Ambient air is introduced into inner channel 112 by the inlet 118, and air exits inner channel 112 through the outlet 124.

The arrows in FIG. 4 within the channels indicate the direction of the air into the channels, through the vortex pattern and out of the channels. The vortex patterns in the channels 108, 110 and 112, are created by a variety of methods. One method is to have the inlets tangential to the channels as described above and seen with inlet 116. It is also possible to have swirlers 134 positioned within the channels 108, 110, and 112 to create the desired pattern. These swirlers 134 are driven by a motor 136 that is also powered by the power supply 130. Another method of creating the vortex pattern of air is to position guide vanes 138 within the channels 108, 110, and 112. Guide vanes 138 initialize the vortex pattern of the air through the channels. The vortex pattern and heat transfer are supplemented by multiple spiral fins 140 and 142 within the channels 108, 110 and 112.

According to the principles of heat transfer explained above using the multichannel recirculatory heat exchange device 10, the air cooler/heater 100 heats ambient air in the outer channel and cools ambient in the inner channel. The cooling and heating is aided by the presence of the thermoelectric sheets as described above. Therefore, cool air is emitted from outlet 124, and warm air is emitted from outlets 120 and 122.

In describing the invention, reference has been made to a preferred embodiment and illustrative advantages of the invention. Those skilled in the art, however, and familiar with the instant disclosure of the subject invention may recognize additions, deletions, modification, substitutions and other changes which will fall within the purview of the subject invention and claims.

What is claimed is:

1. A vortex heat exchanger device for the heat transfer between fluids of different temperatures that flow through said heat exchanger, said heat exchanger comprising;

a plurality of cylindrical tubes each of different diameter and each disposed concentrically relative to one another to define a plurality of concentric channels, said tubes and said channels all having a common longitudinal axis;

at least two inlets for tangentially introducing said fluids into said channels between two of said tubes so that the fluids flow through said channel in a vortex, said inlets are arranged so that said vortex of one fluid runs in a counter direction to the vortex of another fluid; and at least two outlets for tangentially emitting said fluids from said channels.

2. A vortex heat exchange device as defined in claim 1, wherein the channels between said inlets and said outlets are unobstructed.

3. A vortex heat exchange device as defined in claim 1, further comprising recycle connectors between said inlets and said outlets so that at least a part of said fluids emitted from said device is introduced into said device.

4. A vortex heat exchange device as defined in claim 3, wherein said inlets are connected so that said fluid of one temperature is connected to one source and said fluid of another temperature is connected to another source.

5. A vortex heat exchanger device for the heat transfer between fluids of different temperatures that flow through said heat exchanger, said heat exchanger comprising;

a plurality of cylindrical tubes each of different diameter and each disposed concentrically relative to one another to define a plurality of concentric channels, said tubes and said channels all having a common longitudinal axis;

at least two inlets for tangentially introducing said fluids into said channels between two of said tubes so that the fluids flow through said channel in a vortex, said inlets are arranged so that said vortex of one fluid runs in a counter direction to the vortex of another fluid; and at least two outlets for tangentially emitting said fluids from said channels;

said device further comprising recycle connectors between said inlets and said outlets so that at least a part of said fluids emitted from said device is introduced into said device, said inlets being connected so that said fluid of one temperature is connected to one source and said fluid of another temperature is connected to another source;

said two inlets being connected to a common inlet and said common inlet comprising a vane to regulate the flow at amount of said fluid of one temperature between said channels.

6. A vortex heat exchange device as defined in claim 5, wherein said recycle connection further comprising another vane to regulate the flow and amount of said fluids emitted from said device and recycled back into said device.

7. A vortex heat exchange device as defined in claim 6, wherein said outlets are connected.

8. A vortex heat exchange device as defined in claim 7, wherein said recycle connectors connects said common inlets and said common outlets.

9. A vortex heat exchange device as defined in claim 8, wherein said common outlets further comprising a third vane.

10. A recirculatory vortex heat exchanger device for the heat transfer between fluids of different temperatures that flow through said heat exchanger, said heat exchanger comprising:

a plurality of tubes each of different diameter and each disposed concentrically relative to one another to define a plurality of channels, at least two inlets for tangentially introducing the fluids into one set of said channels so that said fluid proceeds through said channel in a vortex, said inlets are arranged so that said vortex of one fluid runs in a counter direction to the vortex of another fluid;

at least two outlets for tangentially emitting the fluids from the other set of said channels;

at least two connectors for connecting said channels with inlets to said channels with outlets, said connectors tangentially introducing said fluid into said channels with outlets from said channels with inlets so that said fluid flows through said channels with outlets in a vortex; and recycle connectors for connecting said inlets to said outlets for recycling said fluids within said heat exchanger;

said inlets being connected so that said fluid of one temperature is connected to one source and said fluid of another temperature is connected to another source, said inlets being connected to a common inlet with said common inlet further comprising a vane for regulating the flow and amount of said fluid of one temperature entering into said channels.

11. A recirculatory vortex heat exchanger device as defined in claim 10, wherein said outlets are connected to form common outlets for said fluids emitted from said device and wherein said recycle connectors connects said common outlet with said common inlet.

12. A recirculatory vortex heat exchange device as defined in claim 11, wherein said common outlets further comprising another vane; and said recycle connectors further comprising a third vane for regulating the flow and amount of said fluid being recycled between said common outlets and said common inlets.

* * * * *